US005179971A

United States Patent [19]

Jackson

[11] Patent Number: 5,179,971

[45] Date of Patent: Jan. 19, 1993

[54] SIDEWALL SUPPORT FOR DUAL CONTAINMENT VESSELS

[76] Inventor: Melvin D. Jackson, 7220 201st NE., Arlington, Wash. 98223

[21] Appl. No.: 862,601

[22] Filed: Apr. 1, 1992

[51] Int. Cl.[5] ..... B65D 25/00

[52] U.S. Cl. ..... 137/264; 220/565; 220/506

[58] Field of Search ..... 220/4.12, 565, 553, 220/506; 137/264; 73/49.2, 49.3

[56] References Cited

U.S. PATENT DOCUMENTS 3,414,155 12/1968 Corvino ..... 220/4.12
4,008,777 1/1978 Humphrey ..... 220/565
5,002,195 3/1991 Lasson ..... 220/4.12
5,129,534 7/1992 Dunn ..... 220/4.12 X

*Primary Examiner*—Alan Cohan
*Attorney, Agent, or Firm*—David L. Garrison

[57] ABSTRACT

A dual wall containment vessel for liquids including environmentally hazardous fluids having a recessed foundation for supporting the sidewalls of the primary containment tank while maintaining a fluid impermeable secondary tank that completely surrounds and contains the primary tank. The present invention further provides for containment and detection of leaks occurring in the primary tank, the secondary tank, or both by utilizing multiple floors and routing of escaped fluids to locations at which they can be detected or observed.

20 Claims, 3 Drawing Sheets

FIG. 3A
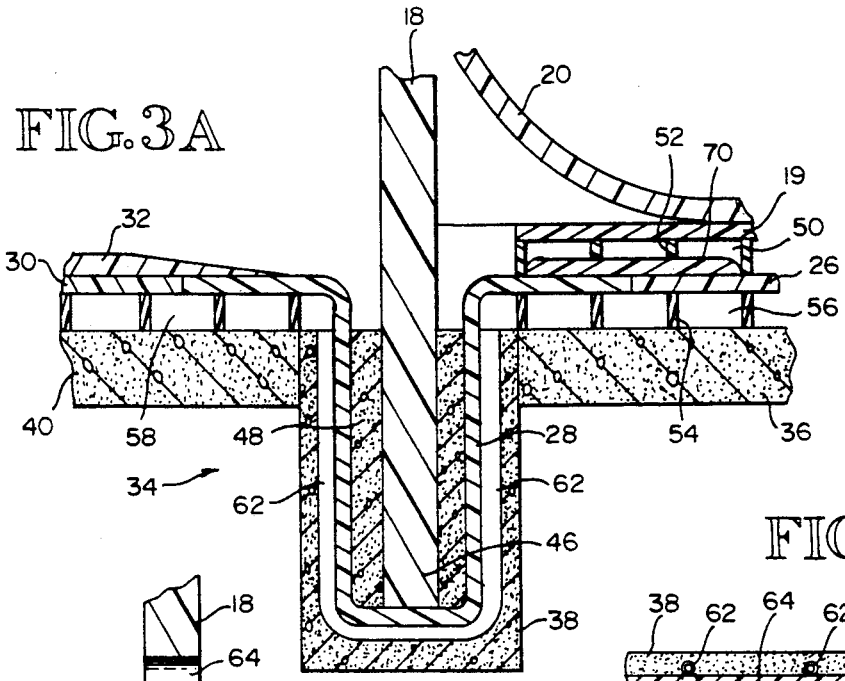
FIG. 6
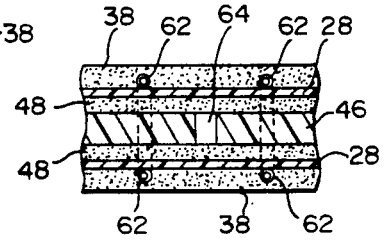
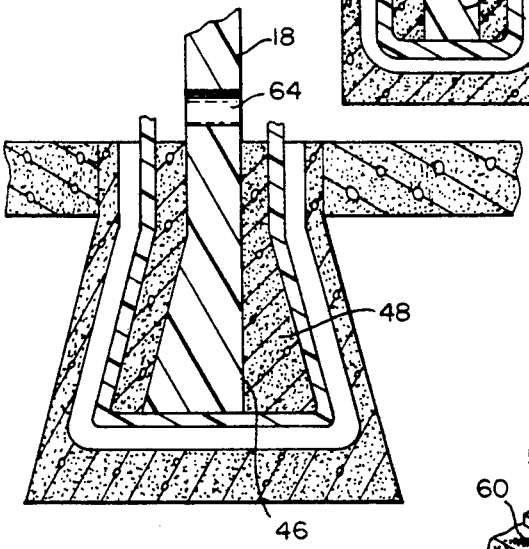
FIG. 4
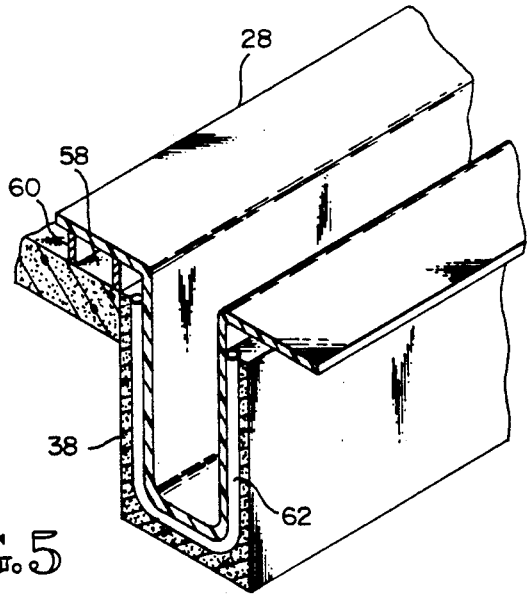
FIG. 5

SIDEWALL SUPPORT FOR DUAL CONTAINMENT VESSELS

BACKGROUND OF THE INVENTION

1. Technical Field

The present invention relates to a support system for anchoring sidewalls of a dual containment vessel and for employing an integral leak detection system. More particularly, it provides for a recessed foundation arrangement for securely supporting a primary tank sidewall above a secondary tank floor member, allowing said floor to be a continuous membrane. This arrangement advantageously decreases the susceptibility of the primary tank to overturning when subject to seismic activity, yet maintains the integrity of the dual containment vessel system. In addition, the present invention provides a means for the monitoring o fluids that have breached the primary and/or secondary containment tanks.

2. Background Art

The construction and use of containment vessels having a dual wall type of construction is well known. These structures are commonly known as a tank-within-a-tank, although other manifestations exist. Vessels or tanks of this nature are typically used for storage of environmentally hazardous materials, especially fluids, because the second surrounding tank contains any fluid leaking from the primary tank and protects the surrounding environment from the same. The construction and use of containment vessels or tanks having a continuous recessed base foundation support system is also well known. Such systems are better able to withstand external forces such as wind and seismic activity.

In furtherance of the goal to provide a leak-proof containment vessel, inventions have been proposed to meet this challenge. The predominant solution has employed multiple containment structures, usually comprising a primary tank enclosed by a secondary tank. In this manner, should a breach occur in the primary tank, any liquid escaping therefrom would be retained by the secondary tank. A collateral benefit is that the secondary tank often provides a means to shield the primary tank from undesirable attacks (e.g. corrosion, impact, etc.).

Because such dual containment structures usually contain environmentally hazardous fluids, detection of a breach of the primary tank is essential. To this end, inventions have been proposed to monitor the secondary containment tank for the presence of the liquid contained in the primary tank. Should liquid be detected in the secondary tank, steps then could be taken to evacuate and repair the primary tank. In this manner, integrity of the system and safety of the environment could be maintained.

However, efficient detection of a breach in the secondary containment tank has not been previously addressed. For example, should a breach occur in the primary tank and the secondary tank also has become defective or violated, a means to detect a secondary tank leak becomes essential to ensure the continued safety of the surrounding environment.

When designing large dual containment vessels, the ability of that structure to withstand external forces is an important design factor. Because the primary tank has primary responsibility for containing the liquid and is subject to the greatest stress, it is of particular importance to design the anchoring method of that tank such that it will not buckle or break during external influences such as seismic activity in addition to withstanding internal forces encountered during normal use. As the height of a dual containment vessel increases the internal hydrostatic pressures and overturning movement due to external forces naturally increase. Therefore, the anchoring system used must be adequate to ensure the integrity of the vessel. Presently, anchoring systems are used that typically include piercing or severing a floor member of a secondary tank in a dual tank system. Such methods impinge on the structural soundness of the secondary tank, thereby decreasing its effectiveness should a breach occur in the primary tank. A need therefore exists to provide a dual containment vessel that has a superior resistance to external forces such as seismic activity and that does not decrease the integrity of the secondary tank.

Single containment vessels have identified and dealt with these factors. Very early designs of single containment vessels relied on the weight of the structure to keep it secure and immobile. Subsequent designs incorporated anchoring the structure using external attachments primarily comprising "L" brackets attached to the vessel and a foundation. While these newer designs were an improvement, they did not provide total structural integrity—shearing forces would cause the anchors to fail. The most recent incarnation involves a subterranean foundation system. This system comprises an annular trough roughly the diameter of the vessel walls into which wall footings are placed, much like the foundations formed for buildings or residential housings. This recessed foundation system advantageously provides for an increased resistance to undesirable external forces and a secure means for anchoring the vessel.

While this system provides a means for soundly supporting and anchoring single containment vessels, this technique has not been utilized in the construction and use of dual containment vessels. Consequently, such a foundation system lacks the ability to contain liquid escaping from the vessel and the ability to monitor for such conditions. Alternatively, dual containment vessels do provide this leak protection, but heretofore lack the structural integrity inherent in the recessed foundation system employed by the single containment vessels. Therefore a need clearly exists to have a containment vessel system that could employ the advantages of a foundational support system employed by the single containment system with the leak prevention and detection means found in a dual containment system. Heretofore, this need has not been met.

DISCLOSURE OF THE INVENTION

It is therefore an object of the present invention to provide a dual containment vessel that utilizes a recessed foundation system thereby providing structural integrity to and resistance to seismic forces of the primary tank while maintaining the fluid impervious nature of the secondary tank floor. Another object of the present invention is to provide a simple means for detecting a leak to determine if a breach has occurred in the primary tank, the secondary tank's floor, or both.

A dual containment vessel constructed according to the present invention comprises a primary tank incorporating a primary recessed foundation system which is wholly contained within a secondary tank. The primary tank is basically characterized by a vertically oriented primary sidewall and a generally horizontal primary floor that is sealingly interconnected to the primary sidewall. The secondary tank is basically characterized by a secondary sidewall, also vertically oriented, and a secondary floor system which is generally horizontal.

The secondary floor system can be characterized as a first secondary floor portion, which is generally spaced from and located below the primary floor member, a recessed secondary floor portion, and a second secondary floor portion which is locate radially outwardly from the first secondary floor portion. The secondary floor portions together form the secondary floor system which is sealingly interconnected to the secondary sidewall thereby forming the fluid impervious secondary tank. It should be noted that the secondary floor system may be a single unit or constructed from components.

A foundation system having an inner primary foundation portion, a primary recessed foundation portion, an outer foundation portion, and a secondary recessed foundation portion is provided for supporting the primary and secondary tanks. The inner foundation portion provides support for the first secondary floor portion and the primary floor. The primary recessed foundation portion is located under the primary sidewall and between the inner foundation portion and the outer foundation portion, thereby providing support means for the primary sidewall. The outer foundation portion provides support for the second secondary floor portion. The secondary recessed foundation portion is under the secondary sidewall and provides the necessary support means for that structure.

The primary recessed foundation portion described above receives the lower peripheral sidewall portion of the primary sidewall with grout material being used to fill the void on either side of said peripheral portion. This arrangement provides a cantilever-type support for the primary sidewall. The recessed secondary floor portion follows the contours of the primary recessed foundation portion remaining adjacent to said lower peripheral edge portion of the primary sidewall. This allows the secondary floor system to form a continuous membrane with the primary tank wholly contained within the secondary tank.

In a preferred embodiment, the primary floor is spaced from, and supported by, the first primary grate which rests on the first secondary floor portion. The space created by the first primary grate forms the first primary void. This primary void allows any liquid leaking through the primary floor to flow directionally between the primary floor and the first secondary floor portion to predetermined locations. Weep holes are placed at these locations to permit fluid passage to the secondary tank, thereby providing an early means for detecting a breach in the primary tank.

The first secondary floor portion is spaced below the primary floor member and is supported by the first secondary grate which rests on the inner foundation portion. The space created by the first secondary grate forms the first secondary void. This first secondary void allows any liquid having escaped the confines of the first primary void to flow directionally between the first secondary floor and the inner foundation to predetermined locations. Conduits or drain tubes can be placed at these locations to permit fluid passage to the outer portion of the structure for effective containment and easy detection.

The outer portion of the structure referenced above is characterized as the second secondary void created by the second secondary grate intermediate the outer foundation and the second secondary floor portion. This arrangement is similar to the first secondary floor portion in that fluid contained therein flows directionally to predetermined locations. In the best mode for carrying out this invention, fluid detection means are situated at these predetermined locations. Examples of fluid detection means range from sight glasses to mechanical, electrical, sonic fluid detectors to portholes from which fluid may be measured and/or evacuated.

A feature of the invention includes a provision for sloping the first secondary floor portion in the direction of at least one weep hole in order to facilitate early detection of a breach in the primary floor.

Another feature of the invention includes the placement of a conduit or drain tube adjacent to the lower primary sidewall within the primary recessed foundation portion forming a fluid passageway between the first secondary void and the second secondary void. Thus, the conduit allows any fluid leaking through both the primary floor and the first secondary floor portion to flow into the second secondary void.

According to another feature of the invention and as described above, fluid detection means are placed in the secondary side wall such that fluid in the second secondary void is able to flow thereto. This provides a visual, mechanical, or electrical means of detecting a leak either in the primary floor and first secondary floor portion, or in the second secondary floor portion should fluid be present in the secondary tank.

Another feature of the invention provides for the fabrication of the recessed secondary floor portion to be produced as a separate tray which can be inserted into the primary recessed foundation portion and then later connected to adjacent trays and the first secondary floor portion and the second secondary floor portion. This allows greater ease and flexibility of construction of the invention.

Other features, objects, and advantages of the invention are hereinafter described in the description of the best mode or preferred embodiment of the invention.

BRIEF DESCRIPTION OF THE DRAWINGS

In the drawings, like reference characters designate like parts throughout the several views, and:

FIG. 3A is an enlarged sectional view of the recessed foundation portion of FIG. 2, showing a drain tube, a portion of the secondary floor member and a lower portion of the primary sidewall;

FIG. 4 is a sectional view like FIG. 3, showing a second preferred embodiment of the invention;

FIG. 5 an isometric view of the recessed secondary floor portion including the conduit tube, and the surrounding foundation portions;

FIG. 6 is a plan view taken substantially along line 6—6 in FIG. 3, showing an enlarged view the relationship between the conduit tubes and the primary recessed foundation, and the primary sidewall and primary weep hole.

BEST MODE FOR CARRYING OUT THE INVENTION

Figure 1:
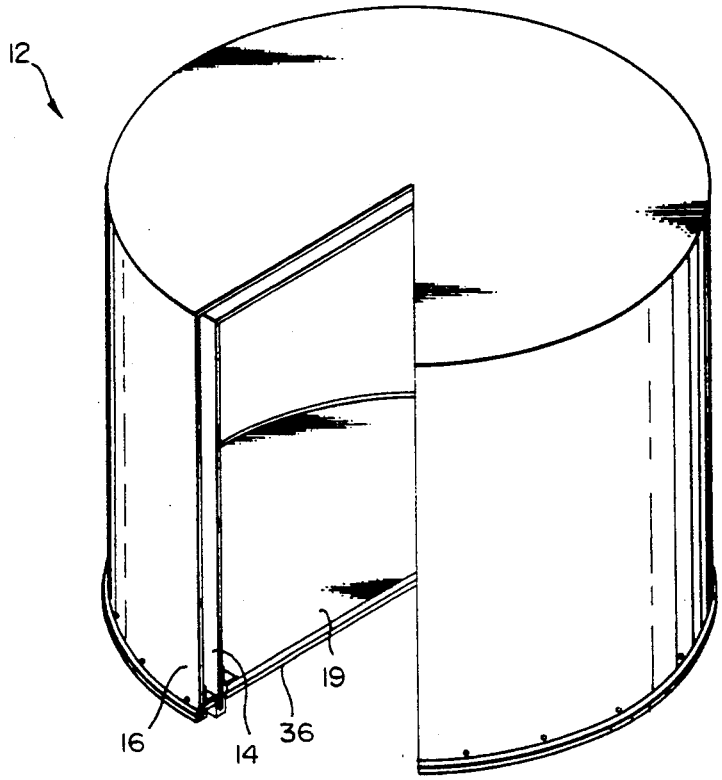
FIG. 1 is an isometric view of a dual containment vessel showing a secondary tank partially broken away to show a portion of a primary tank.

The present invention concerns a dual containment vessel, as shown in a preferred embodiment in FIG. 1 as numeral 12. Dual containment vessel 12 comprises primary tank 14, completely surrounded by and wholly contained in secondary tank 16. Because of the unique nature and construction of this invention, it will be described in general terms with attention being drawn to specific aspects or alternative preferred embodiments.

Figure 3:
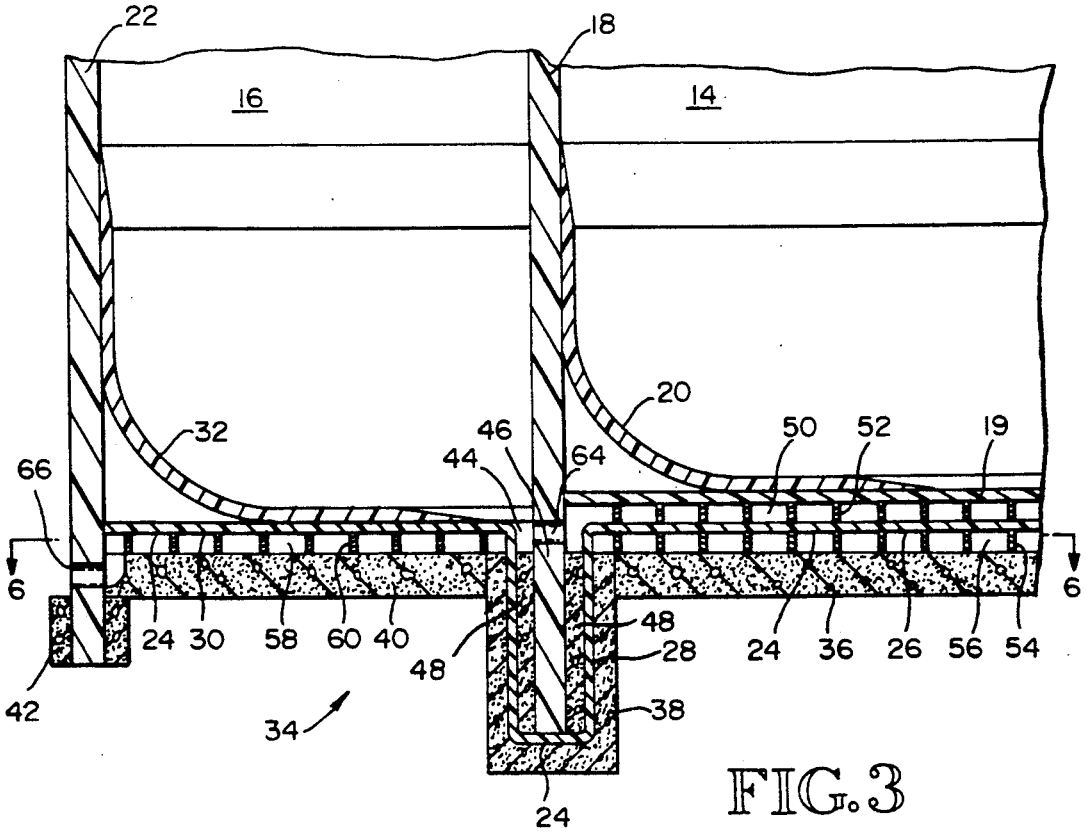
FIG. 3 is a sectional view of a preferred embodiment showing the relationship between the primary sidewall, primary floor, secondary sidewall and secondary floor, and the supporting foundation portions.

Referring to FIG. 1 and FIG. 3, entire dual containment vessel 12 rests on foundation system 34 having four identifiable portions: an inner foundation portion 36, a recessed foundation portion 38, an outer foundation portion 40, and a secondary recessed foundation portion 42. Foundation system 34 may be constructed as one unit or as sequentially formed components later interconnected to each other. However, foundation system 34 should be treated as one unit with specifically identifiable portions. Foundation system 34 can be constructed using a reinforced concrete construction method or other suitable methods known to those skilled in the art.

Inner foundation portion 36 and outer foundation portion 40 may be level or sloped as will be described in an alternative preferred form below. Both portions are formed to sufficient thickness to support the anticipated loads and external forces acting on dual containment vessel 12. Primary recessed foundation portion 38 forms an inner annular groove or well 44 which is typically at least 6 inches deep, but may vary depending on the diameter or height of primary tank 14. Into this annular groove is placed recessed secondary floor portion 28 and primary sidewall 18. Secondary recessed foundation portion 42 likewise forms an annular groove or well into which secondary sidewall 22 is located.

Secondary floor system 24 is located above foundation system 34. Just as foundation system 34 has identifiable portions, so does secondary floor system 24: first secondary floor portion 26, recessed secondary floor portion 28, and second secondary floor portion 30. Secondary floor system 24 may be constructed as one unit as shown in FIG. 3, or as components as shown in FIG. 3A. It is usually necessary to construct secondary floor system 24 in components only when fabricating a large diameter vessel. In such a case, first secondary floor portion 26, recessed secondary floor portion 28, and second secondary floor portion 30 are sealingly interconnected by means of bonding laminate 70 and secondary knuckle 32.

As illustrated in FIG. 3, secondary floor system 24 generally follows the contours of foundation system 34. In a preferred form, first secondary floor portion 26 is supported by a first secondary grate 54. First secondary grate 54, resting on inner foundation portion 36, elevates first secondary floor portion 26 thereby creating first secondary void 56 through which fluid may travel. In a similar manner, second secondary floor portion 30 is supported by second secondary grate 60. Second secondary grate 60, resting on outer foundation portion 40, elevates second secondary floor portion 30 thereby creating second secondary void 58 through which fluid may travel. Recessed secondary floor portion 28 is located in the void created by primary recessed foundation portion 38.

FIG. 3A shows in detail a preferred form of the present invention whereby fluid conduit 62, also referred to as drain tube 62, connects first secondary void 56 with second secondary void 58. Preferably, fluid conduit or drain tube 62 is located between primary recessed foundation portion 38 and recessed secondary floor portion 28. In this manner, fluid can advantageously pass from the confines of primary sidewall 18 to the confines of secondary sidewall 22 without having to pass though primary tank 14. A distinct advantage of using fluid conduit 62 is that fluid having escaped both primary floor 19 and first secondary floor portion 26 will migrate to fluid conduit 62 instead of collecting undetected on inner foundation portion 36.

Previously it was mentioned that inner foundation portion 36 may be sloped. By sloping inner foundation portion 36 towards fluid conduit 62, detection of a breach in primary floor 19 and first secondary floor portion 26 can be more rapidly determined. Moreover, it was also previously mentioned that outer foundation portion 40 could likewise be sloped. By imparting a slope in outer foundation portion 40 towards a fluid detection mean 66 for example, fluid detection could further be enhanced. Fluid detection means 66 will be discussed in more detail below.

Referring back to FIG. 3, secondary sidewall 22 in a preferred form comprises a generally vertical, continuous fiberglass or fiber-filament shell that may be constructed on or off site. Secondary sidewall 22 is located at the perimeter of outer foundation portion 40 and sealingly interconnected with second secondary floor portion 30 to form a fluid impermeable secondary tank wholly enclosing primary tank 14. The aforementioned sealing interconnection may be accomplished by conventional means such as filleting or bonding, or by means of secondary knuckle 32.

In a preferred form, secondary sidewall 22 depends into secondary recessed foundation portion 42 located at the perimeter of outer foundation portion 40 and is anchored therein using a non-shrink epoxy grout or appropriate substitute. In previous experiments and use, a commercially available epoxy grout, Fosroc Conbextra EPHF, has been used for this purpose. Those persons skilled in the art will appreciate that other types of grout or bonding compounds may be substituted depending upon the needs of the job and materials involved.

In a preferred form, at least one fluid detection means 66 is located at secondary sidewall 22 connected with second secondary void 58. The purpose of this fluid detection means is to indicate the presence or level of fluid in second secondary void 58. As described above, presence of fluid in second secondary void 58 would signify that both primary tank 14 and secondary tank 16 have been breached. Such an event would also signify that the integrity of dual containment vessel 12 had been severely compromised and that immediate action should be taken before the surrounding environment becomes contaminated.

Detection of a leak in primary floor 19 and first secondary floor portion 26, or in primary sidewall 18 and second secondary floor portion 30 is accomplished by fluid detection means 66. Such fluid detection means may comprise a visual means such as a porthole or sight glass, electronic means such as a conductivity sensor, or mechanical means such as a float mechanism located at 66. The foregoing examples are intended to illustrate the wide variety of leak detection means, and are not intended to limit the aforementioned detection means as persons skilled in the art may vary the means and location to best meet their needs. It should be noted that fluid detection means 66 is preferably located at the periphery of dual containment vessel 12 because such a location is easily accessible and requires little, if any, invasion of dual containment vessel 12. Therefore, inspection and servicing of the detector means ca be accomplished from the exterior of dual containment vessel 12.

To enhance the early detection of fluid that has breached primary tank 14 and secondary floor system 24, in a preferred form outer foundation portion 40 is sloped towards fluid detection means 66. In this manner, fluid contained in second secondary void 58 would migrate towards the lowest portion of sloped outer foundation portion 4 wherein is located aforementioned fluid detection means 66. Another enhancement is to locate a plurality of fluid detection means 66 about secondary sidewall 22 and slope outer foundation portion 40 thereto. As described previously, inner foundation portion 36 can be sloped towards conduit 62 or a plurality of conduits 62. And an extremely advantageous embodiment will employ a combination of the above wherein inner foundation portion 36 is sloped towards at least one conduit 62 and outer foundation portion 40 is sloped towards at least one fluid detection means 66.

Turning now to primary tank 14, primary sidewall 18 in a preferred form comprises a continuous fiberglass or fiber-filament shell that may be constructed on or off site. Primary sidewall 18 is located in annular trough or well 44 that was created by primary recessed foundation portion 38 and recessed secondary floor portion 28. Grout material 48, the same non-shrink epoxy as previously described, anchors primary sidewall 18 in annular trough 44 and recessed secondary floor portion 28 in primary recessed foundation portion 38. Primary floor 19, supported above first secondary floor portion 26 by primary grate 52, is located adjacent to primary sidewall 18. Primary grate 52 also creates primary void 50 through which fluid may travel. Primary floor 19 and primary sidewall 18 are sealingly interconnected to form a fluid impermeable membrane. This sealing interconnection may be accomplished by conventional means such as filleting or bonding, or by means of primary knuckle 20. An advantage of using primary knuckle 20, typically an arcuate portion with tangentially extending ends to aid interconnection, is that flexing of said knuckle can occur during fluid loading without endangering the integrity of the weaker joint between primary sidewall 18 and primary floor 19.

In a preferred form, at least one primary weep hole 64 is located at primary sidewall 18. Primary weep hole 64 is typically a tube or orifice at least ½ inch to 1 inch in diameter. The purpose of primary weep hole 64 is to create a fluid pathway from first primary void 50, created by first primary grate 52, to secondary tank 16. Thus, the presence of fluid in secondary tank 16 originating from primary weep hole 64 would indicate that primary floor 19 had been breached. Remedial steps could then be taken to repair damaged primary floor 19.

To enhance the early detection of fluid that have breached primary floor 19, first secondary floor portion 26 is sloped towards primary weep hole 64. In this manner, fluid contained in first primary void 50 would migrate towards the lowest portion of sloped first secondary floor portion 2 wherein is located primary weep hole 64. Said fluid would exit primary tank 14 through primary wee hole 64 and enter secondary tank 16 for detection and containment. Another enhancement is to locate a plurality of primary weep holes 64 about primary sidewall 18 and slope first secondary floor portion 26 towards said plurality of primary weep holes 64.

Detection of a leak in primary floor 19 is accomplished by leak detection means. Such leak detection means may comprise primary weep hole 64, or primary weep hole 64 used in conjunction with visual inspection means such as a porthole located in secondary sidewall 22, electronic means such as a conductivity sensor located at second secondary floor portion 30, mechanical means such as a float mechanism, or sonic means directed towards second secondary floor portion 30. The foregoing examples are intended to illustrate the wide variety of leak detection means, and are not intended to limit the aforementioned detection means.

In FIG. 4, a second embodiment of the present invention is disclosed. Lower peripheral sidewall portion 46 is enlarged at its outer portion during the manufacturing process to increase the pull-out strength and thereby increase the overall structural integrity of primary sidewall 18

Figure 2:
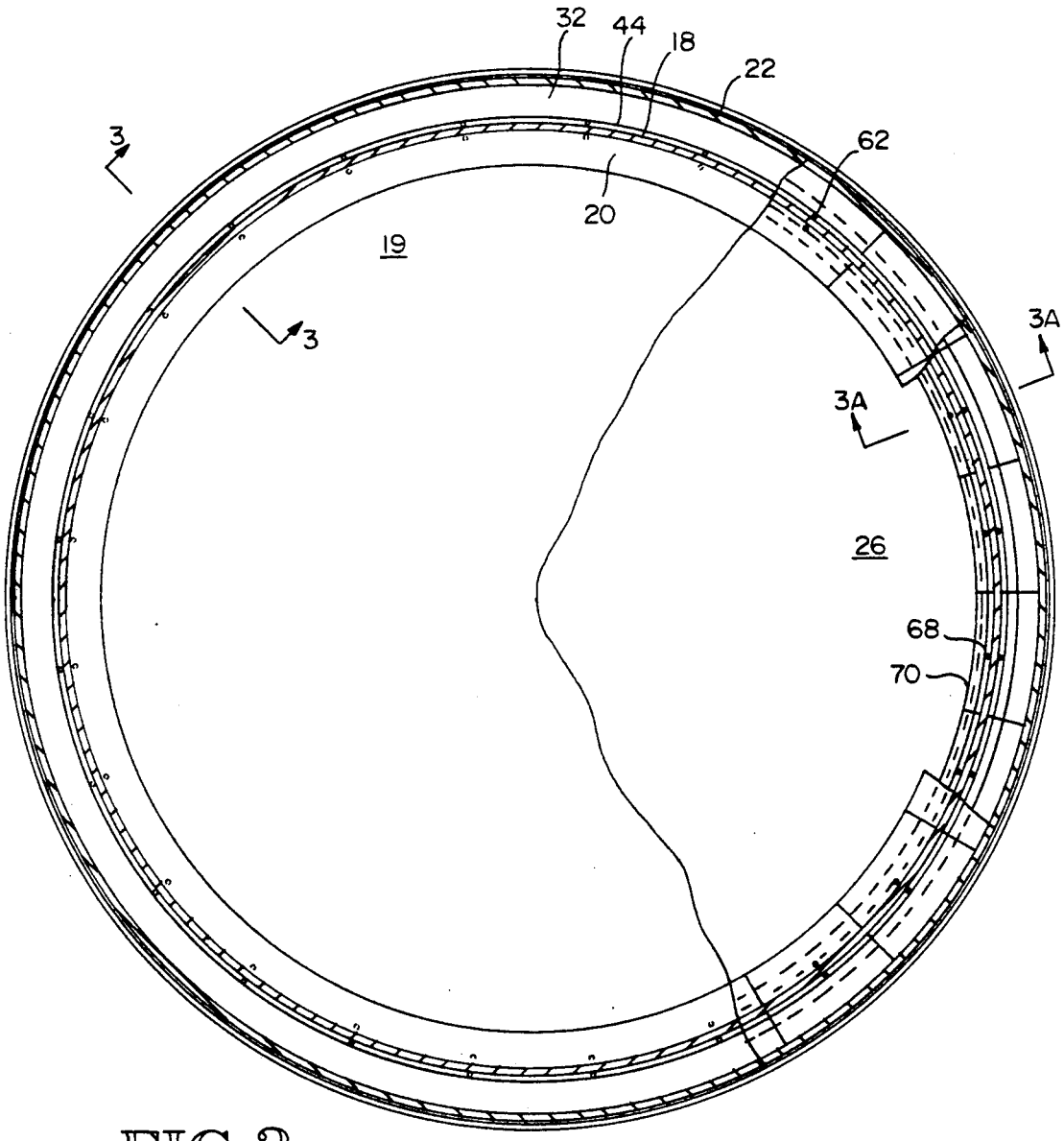
FIG. 2 is a plan view of two embodiments of the present invention: the left portion representing a form where the recessed secondary floor portion is continuous; and the right portion representing a form where the recessed secondary floor portion comprises tray components.

FIG. 5 presents an isometric view of a preferred form of recessed secondary floor portion 28 wherein conduit member can be clearly related to its surroundings. In this view, recessed foundation portion 28 is one of three separate components that comprise secondary floor system 24. Should the construction process require that recessed secondary floor portion 28 be constructed in segments, FIG. 2 demonstrates how a series of trays 68 can be sealingly interconnected to form recessed secondary floor portion 28.

METHOD OF CONSTRUCTING THE PRESENT INVENTION

Ideally, construction of dual containment vessel 12 would be to construct or fabricate the structure using as few pieces as possible so as to reduce the need to bond or connect pieces together. Smaller tanks, especially those which can be radially built within a factory, will have components such as primary floor 19 and secondary floor system 24, constructed as a single piece. However, as the volumes of the primary and secondary tanks 14 and 16 increase, and require that the pieces be assembled at a job site, it becomes necessary to increase the number of pieces and therefore the number of joints that must be fabricated in the field. In order to simplify fabrication and construction in the field, the present invention provides that first secondary floor portion 26 can be fabricated as one piece, then recessed secondary floor portion 28 can be fabricated as a second component and later sealingly connected to first secondary floor portion 26 and second secondary floor portion 30 by means of bonding laminate 70. In addition, as shown in FIG. 7, recessed secondary floor portion 28 can be constructed of a plurality of trays 68 essentially trapezoidal in shape which fit together to form recessed secondary floor portion 28.

For construction of large dual containment structures, the ground is first prepared and then foundation system 34 and recessed foundation portions 38 and 42 are constructed. First secondary and second secondary grates 54 and 60 may be placed on the respective foundations 36 and 40. Prefabricated first secondary floor portion 26, recessed secondary floor portion 28, and second secondary floor portion 30 then may be placed in position and connected by a bonding laminate 70. It should be noted that recessed secondary floor portion 28 and conduit member 62 can be fabricated together such that when inserted into well 44, conduit member 62 is flush with the top of recessed foundation portion 38.

Next, secondary sidewall 22 may be inserted into secondary recessed foundation portion 42 and anchored therein using, for example, a non-shrink epoxy grout. Secondary knuckle 32 is then placed within secondary tank 16 and sealingly interconnected to secondary sidewall 22 and second secondary floor portion 30. Such interconnections may comprise laminating, bonding, welding, or other commercially acceptable means for the components used. Primary sidewall 18 may then be inserted into well 44, with lower peripheral sidewall portion 46 being held therein by grout 48. The next step includes the fabrication and placement of primary floor 19 on top of first grate 52. Primary knuckle 20 is then placed within primary tank 14 and sealingly interconnected as described above to primary floor 19 and primary sidewall 18.

All bonding laminates and interconnections are constructed preferably from the same type of material as used for constructing the tanks. All grout material used for anchoring secondary side wall 22 in secondary recessed foundation portion 42, primary side wall 20 in annular trough 44, and recessed secondary floor portion 28 in primary recessed foundation portion 38 is preferably a non-shrink epoxy grout such as commercially available Fosroc Conbextra EPHF.

INDUSTRIAL APPLICABILITY

The present invention will find utility in the storage of hazardous fluids used in industry. The novel features of this invention provide for a simple means of detecting a leak in both the primary and/or secondary tanks, thereby reducing the risk of a fluid spill and environmental contamination.

From the foregoing, further modifications, component arrangement, and modes of utilization of the invention are apparent to those skilled in the art which the invention is addressed. The scope of protection is not to be limited by the details of embodiment which have been illustrated and described. Rather, the scope of protection is to be determined by the appended claims interpreted in accordance with the established rules of patent claim interpretation.

What is claimed is:

1. A dual containment vessel for potentially environmentally hazardous fluid containing compounds comprising:

a foundation system having an inner foundation portion, a primary recessed foundation portion spaced radially outwardly therefrom, and an outer foundation portion spaced radially outwardly therefrom, said inner foundation portion substantially supporting first secondary floor portion, said primary recessed foundation portion substantially supporting a recessed secondary floor portion, and said outer foundation portion substantially supporting a second secondary floor portion;

a secondary floor system having said first secondary floor portion, recessed secondary floor portion, and second secondary floor portion forming a fluid impermeable secondary floor membrane;

a vertically oriented primary sidewall and a generally horizontal primary floor, said primary recessed foundation portion supporting said primary sidewall, said first secondary floor portion supporting said primary floor, and said primary sidewall and primary floor being sealingly interconnected to form a fluid impermeable primary tank;

a vertically oriented secondary sidewall and a generally horizontal secondary floor system, said secondary floor system and secondary sidewall being sealingly interconnected to form a fluid impermeable secondary tank; and means for rigidly supporting the primary sidewall in a recess created by the recessed secondary floor portion.

2. A vessel as in claim 1 wherein a first secondary grate supports and elevates the first secondary floor portion creating a first secondary void, a second secondary grate supports and elevates the second secondary floor portion creating a second secondary void, and a first primary grate supports and elevates the primary floor creating first primary void, wherein each void permits fluid passage therein; and at least one primary weep hole located at the primary sidewall, said weep hole allowing fluid migrating from the first primary void to pass though and enter the secondary tank for detection of a breached primary floor.

3. A vessel as in claim 2 further comprising a means for detecting fluid leaking from the primary tank.

4. A vessel as in claim 2 wherein the first secondary floor portion slopes towards the primary weep hole to facilitate detecting a breached primary floor.

5. A vessel as in claim 2 wherein the first secondary floor portion slopes towards a plurality of weep holes located at the primary sidewall.

6. A vessel as in claim I wherein at least one means for detecting fluids is located at the secondary sidewall.

7. A vessel as in claim 2 wherein at least one means for detecting fluid is located at the secondary sidewall.

8. A vessel as in claim 1 wherein at least one means for detecting fluid is located within the second secondary void for the detection of fluid having breached both the primary tank and secondary floor system.

9. A vessel as in claim 2 wherein at least one means for detecting fluid is located within the second secondary void for the detection of fluid having breached both the primary tank and secondary floor system.

10. A vessel as in claim 2 wherein the outer foundation portion slopes towards the means for fluid detection located at the secondary sidewall.

11. A vessel a in claim 2 wherein the outer foundation portion slopes towards a plurality of means for fluid detection located at the secondary sidewall.

12. A vessel as in claim 2 further comprising a conduit member defining a fluid flow path between the first secondary void and the second secondary void, said conduit member extending between the first secondary void and the second secondary void.

13. The vessel as in claim 12 wherein said conduit member extends between the first secondary void and the second secondary void and is located between the primary recessed foundation portion and the recessed secondary floor portion.

14. A vessel as in claim 2 wherein a primary knuckle provides the sealing interconnection between the primary sidewall and the primary floor, and a secondary knuckle provides said sealing interconnection between the secondary sidewall and the second secondary floor portion.

15. The vessel of claim 1 wherein the secondary floor system comprises a separate first secondary floor portion, a recessed secondary floor portion, and a second secondary floor portion sealingly interconnected to form a fluid impermeable secondary floor membrane.

16. The vessel as in claim 15 wherein the recessed secondary floor portion comprises a plurality of trays, said trays being sealingly interconnected to form a fluid impermeable recessed secondary floor portion.

17. A dual containment vessel for potentially environmentally hazardous fluid containing compounds comprising:

a foundation system having an inner foundation portion, a primary recessed foundation portion spaced radially outwardly therefrom, an outer foundation portion spaced radially outwardly therefrom;

a first secondary grate substantially supporting an elevated secondary floor portion from said inner foundation creating a first secondary void, a primary recessed foundation portion substantially supporting a recessed secondary floor portion, a second secondary grate substantially supporting an elevated second secondary floor portion from said outer foundation portion creating a second secondary void wherein each void permits fluid passage;

a secondary floor system having said first secondary floor portion, recessed secondary floor portion, and second secondary floor portion forming a fluid impermeable secondary floor membrane;

a vertically oriented primary sidewall and a generally horizontal primary floor, having a primary grate substantially supporting an elevated primary floor from the first secondary floor portion creating a first primary void wherein fluid may travel, and said primary sidewall and primary floor being sealingly interconnected to form a fluid impermeable primary tank;

a vertically oriented secondary sidewall and a generally horizontal secondary floor system, said secondary floor system and secondary sidewall being sealingly interconnected to form a fluid impermeable secondary tank;

a recess defined by the recessed secondary floor portion for supporting the primary sidewall;

a weep hole located at the primary sidewall defining a fluid pathway from the primary void through into the secondary tank;

a conduit member defining a fluid flow path between the first secondary void and the second secondary void, said conduit member extending between the first secondary void and the second secondary void, and located substantially between the primary recessed foundation portion and the recessed secondary floor portion; and means for fluid detection located at the secondary sidewall.

18. A method for constructing a dual containment vessel comprising the steps of:

preparing a site for a dual containment vessel;

constructing a foundation system comprising an inner foundation portion, a primary recessed foundation portion, and an outer foundation portion;

placing a first secondary grate on the inner foundation portion and a second secondary grate on the outer foundation portion;

placing a secondary floor system over the first secondary grate, the recessed foundation, and the second secondary grate;

locating a secondary sidewall in a secondary recessed foundation portion and sealingly interconnecting the secondary sidewall with the second secondary floor portion;

placing a first primary grate on the first secondary floor portion;

locating a primary sidewall in an annular groove created by the recessed secondary floor portion and anchoring the primary sidewall therein;

placing a primary floor over the first primary grate; and sealingly interconnecting the primary sidewall with the primary floor.

19. The method as in claim 18 wherein the secondary floor system comprises separate portions that are sealingly interconnected at the construction site.

20. The method as in claim 18 whereby a conduit member is formed integral with the recessed secondary floor portion.

* * * * *